US008960243B2

(12) United States Patent
James

(10) Patent No.: US 8,960,243 B2
(45) Date of Patent: Feb. 24, 2015

(54) GOUGING MACHINE FOR DOUBLE REEDS

(76) Inventor: Charles Gregory James, Toronto (CA)

( * ) Notice: Subject to any disclaimer, the term of this patent is extended or adjusted under 35 U.S.C. 154(b) by 1071 days.

(21) Appl. No.: 13/010,808

(22) Filed: Jan. 21, 2011

(65) Prior Publication Data

US 2011/0180181 A1 Jul. 28, 2011

Related U.S. Application Data

(60) Provisional application No. 61/297,836, filed on Jan. 25, 2010.

(51) Int. Cl.
*B27C 1/00* (2006.01)
*B27J 1/00* (2006.01)
*G10D 9/02* (2006.01)

(52) U.S. Cl.
CPC .. *B27J 1/00* (2013.01); *G10D 9/023* (2013.01)
USPC ..... 144/115; 84/383 A

(58) Field of Classification Search
CPC ..... B27G 17/00; B27G 17/02; B27G 17/025; B27G 17/04; B27G 17/06; B27J 1/00; B27C 1/002; B27C 1/02; B27C 1/10; B27C 1/04; G10D 9/02
USPC ..... 144/366, 193.1, 195.6, 195.9, 195.4, 144/195.5, 360, 369, 115, 130, 135.3, 147, 144/186, 344, 345, 278.1, 269; 84/380 R, 84/383 R, 383 A, 385 A, 330; 269/37, 55; 29/281.1
See application file for complete search history.

(56) References Cited

U.S. PATENT DOCUMENTS 5,095,605 A * 3/1992 Tonus ..... 29/432
6,683,238 B1 1/2004 Driscoll, Jr.
7,534,947 B2 5/2009 Heng et al.

* cited by examiner

*Primary Examiner* — Shelley Self
*Assistant Examiner* — Matthew G Katcoff
(74) *Attorney, Agent, or Firm* — Michael B. Einschlag

(57) ABSTRACT

A gouging machine for cane includes: (a) a base; (b) a cane bed, having a trough disposed parallel to a bottom surface of the cane bed, and having grooves on opposing sides thereof that slope at a groove angle with respect to the bottom surface of the cane bed, the cane bed being affixed to the base so that the trough is parallel to a top surface of the base and to a predetermined line; and (c) clamps, disposed on the opposing sides of the cane bed, each clamp having a tongue that slopes at the groove angle with respect to a clamping surface thereof, which clamping surface is adapted to grip edges of cane placed in the trough of the cane bed, and wherein the tongues of the clamps slidably engage the grooves of the cane bed so that the clamping surface of the clamps are parallel to a bottom of the trough.

12 Claims, 4 Drawing Sheets

GOUGING MACHINE FOR DOUBLE REEDS

This patent application relates to U.S. Provisional Application No. 61/297,836 filed Jan. 25, 2010 from which priority is claimed under 35 USC §119(e), and which provisional application is incorporated herein in its entirety.

TECHNICAL FIELD

One or more embodiments of the present invention provide gouging machines for reeds for the double reed family of woodwind instruments such as, for example and without limitation, the oboe, the English horn, the bassoon and the contrabassoon.

BACKGROUND

Bamboo cane from which reeds for the double reed family of woodwind instruments are made grows in the form of a hollow tube. Making a double reed involves selecting cane of an appropriate diameter, cutting a segment of an appropriate length, and splitting it lengthwise—either in thirds or in quarters, depending on the preference of a reed-maker. Double reeds are made from these split pieces of cane, which pieces of cane include an outer surface which is referred to herein as a "bark side" and an inner surface which is referred to herein as a "gouged side."

Bamboo cane has a cross-section formed of two concentric circular arcs and, as split, is too thick for reed making. As such, gouging is one of the first processes carried out on the split piece of cane. Gouging reduces the wall thickness of the piece of cane, and creates a crescent-like cross-section whose thickness is greatest in the centre of the cross-section and becomes thinner at each edge.

Prior art gouging machines traditionally have included: (a) a cane bed with a trough of circular cross-section whose radius of curvature matches that of the bark side of the cane to be gouged; and (b) a cutting tool which is able to slide on a guide rod, which guide rod is fixed parallel to the trough. In the gouging process, a split piece of cane is placed bark side down in the trough of the cane bed to support the cane during the gouging process. The gouging process consists of planing excess material from the gouged side of the split piece of cane using a blade with a curved cutting edge until the cross-section of the cane has reached desired dimensions. The desired dimensions are determined partly by the curvature of the blade, and partly by adjusting mechanisms that regulate: (a) the minimum gap between the trough of the cane bed and the cutting tool; and (b) the lateral position of the cutting tool above the trough. In one type of gouging process, known as single radius gouging, the blade is centered over the trough and the curvature of the blade is directly imparted to the gouged side of the cane. In another type of gouging process, known as double radius gouging, the blade is positioned off center, over the trough, and a symmetrical gouge cross-section is created by repeatedly turning the split piece of cane, end for end, as the gouging process progresses.

Before undergoing the gouging process, the split cane may undergo one or more preparatory operations which save time and wear on the gouging machine itself. These processes may include the following steps: (a) a top cut which reduces the cross-section of the split cane to a desired overall height and width; and (b) a pre-gouge which reduces the wall thickness of the split cane by removing excess material from the gouged side. These preparatory operations are carried out by tools of simple design which rapidly reduce the cross-section of the piece of split cane to slightly above its finished dimensions.

The successful production of double reeds depends in part upon being able to gouge cane to consistent dimensions within specifications, which dimensions include the centre thickness, as measured at all points along the length of the cane, and the side thickness, as measured at a given distance from the centre. It is because of this that problems have arisen with traditional gouging machines. Cane is a naturally growing plant, and does not grow in perfectly round or straight tubes. As such, its outside diameter does not consistently match the circular cross-section of a gouging machine trough. Thus, in spite of the best efforts of reed makers in selecting and splitting tubes of cane, there is a persistent tendency for the curvature of the bark side of a split piece of cane to fail to conform to the curvature of the gouging machine trough along at least a part of its length. In particular, if the curvature of the cane is smaller than that of the trough, the edges of the cane fail to contact the trough and will be gouged too thin—resulting in sides which are too thin in relation to centre thickness. However, if the curvature of the cane is larger than that of the trough, the centre of the cane fails to contact the trough and will be gouged too thin—resulting in a centre thickness which is too thin in relation to side thickness.

Another problem with traditional gouging machines relates to achieving consistent centering of the center of the gouged cross-section between the sides of the split piece of cane. In a traditional gouging machine, the split piece of cane is centered in the trough of the cane bed by eye, and the gouging process tends to cause it to shift position in the trough. As a result, variation in centering the center of the gouged cross-section frequently occurs. Finally, adjusting mechanisms of traditional gouging machines have not made it possible to make adjustments of precisely controlled and known amounts, thereby making it necessary to use trial and error methods when making changes to the dimensions of gouged cane.

In light of the above, there is a need to improve the quality of reeds for the double reed family of woodwind instruments by improving the reliability and accuracy of one of the processes involved in producing such reeds, which process is traditionally called the gouging process.

SUMMARY

One or more embodiments of the present invention solve one or more of the above-described problems. In particular, one embodiment of the present invention is a gouging machine for cane that comprises: (a) a base; (b) a cane bed, having a trough disposed parallel to a bottom surface of the cane bed, and having grooves on opposing sides thereof that slope at a groove angle with respect to the bottom surface of the cane bed, the cane bed being affixed to the base so that the trough is parallel to a top surface of the base and to a predetermined line; and (c) clamps, disposed on the opposing sides of the cane bed, each clamp having a tongue that slopes at the groove angle with respect to a clamping surface thereof, which clamping surface is adapted to grip edges of cane placed in the trough of the cane bed, and wherein the tongues of the clamps slidably engage the grooves of the cane bed so that the clamping surface of the clamps are parallel to a bottom of the trough.

DETAILED DESCRIPTION

Figure 1:
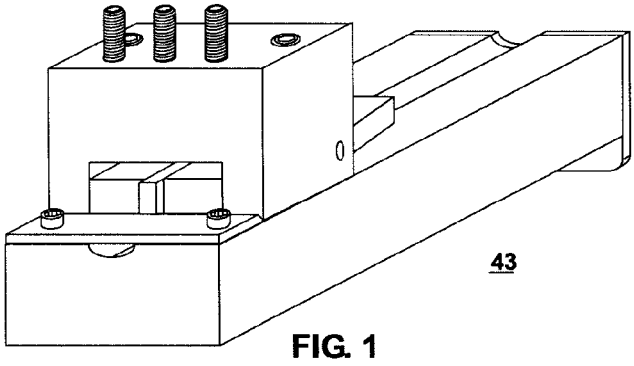
FIG. 1 is an isometric view of a filiere for double reeds that is fabricated in accordance with one or more embodiments of the present invention.

One or more embodiments of the present invention are gouging machines for double reeds that include a cane bed having edge gripping cane clamps which exert a downward force on the edges of the cane. In accordance with one or more such embodiments, the downward forces applied to both edges of the cane by the edge gripping cane clamps cause a bark side of the cane to be pressed against, and make solid contact with, a trough of the cane bed. In addition, and in accordance with one or more such embodiments, the spacing between the edge gripping cane clamps is sufficiently wide that they do not obstruct a cutting tool, which cutting tool may, for example and without limitation, comprise: (a) a blade having a curved cutting edge; or (b) an abrasive tool. As used herein, the term gouging machine also refers to a gouging tool or a gouger.

In accordance with one or more embodiments of the present invention, and as is described in detail below, the clamping surfaces of the edge gripping cane clamps remain at equal heights above, and remain parallel to, a bottom of the trough of the cane bed throughout the gouging process. Consequently, the dimensions of a cross-section of a volume between the clamping surfaces and the trough of the cane bed will be uniform at all points along the length of the cane bed. The more uniform the cross-sectional dimensions of the pre-gouged cane are at all points along the length of the pre-gouged cane, the more uniform the gripping force applied by the edge gripping cane clamps will be at all points along the length of the pre-gouged cane.

In operation, for pieces of cane whose bark sides have a smaller curvature than that of the trough of the cane bed, the gouging machine brings their edges into contact with the trough; whereas, for pieces of cane whose bark sides have a larger curvature than that of the trough, the gouging machine brings their center into contact with the trough. As one of ordinary skill in the art can readily appreciate, if cane to be gouged undergoes a pre-gouging process, after splitting, whereby its wall thickness is reduced, its pliability is increased. As a result, the ability to cause the cane to conform to the curvature of the trough of the cane bed will be increased.

To improve its cross-sectional uniformity, prior to gouging, pre-gouged cane may undergo a trimming process to reduce variations in arc length of the bark side of the cane (where arc length is measured circumferentially, and at right angles to the length of the pre-gouged cane) by an amount sufficient to enable the edge gripping cane clamps to apply a uniform clamping force during gouging throughout the length of the cane. In accordance with one or more embodiments of the present invention, an inventive filiere for double reeds may be used to trim top-cut, pre-gouged cane.

In accordance with one or more embodiments of the present invention, a filiere for double reeds includes: (a) a trough having a circular cross-section; (b) a straight-edged cutting blade that is fastened horizontally at one end of the trough; and (c) spring-loaded hold-downs which press the pre-gouged cane against the surface of the trough before, for example, immediately before, the pre-gouged cane passes the straight-edged blade, which spring-loaded hold-downs include: (a) a hold-down at both edges of the pre-gouged cane; and (b) a hold-down in the centre of the pre-gouged cane. Pre-gouged cane that is trimmed in such a filiere will be clamped firmly by the edge gripping cane clamps of the gouging machine for double reeds at all points along its length, and will thereby, be brought into solid contact with the gouger trough at all points along its length. Also, due to the fact that the clamping surfaces of the edge gripping cane clamps remain at equal heights above, and remain parallel to, the bottom of the trough of the cane bed of the gouging machine throughout the gouging process, the cane will be clamped in a self-leveling manner (i.e., the edges of the pre-gouged cane will be centered on the center of the trough of the cane bed and remain centered) throughout the gouging process.

Figure 2:
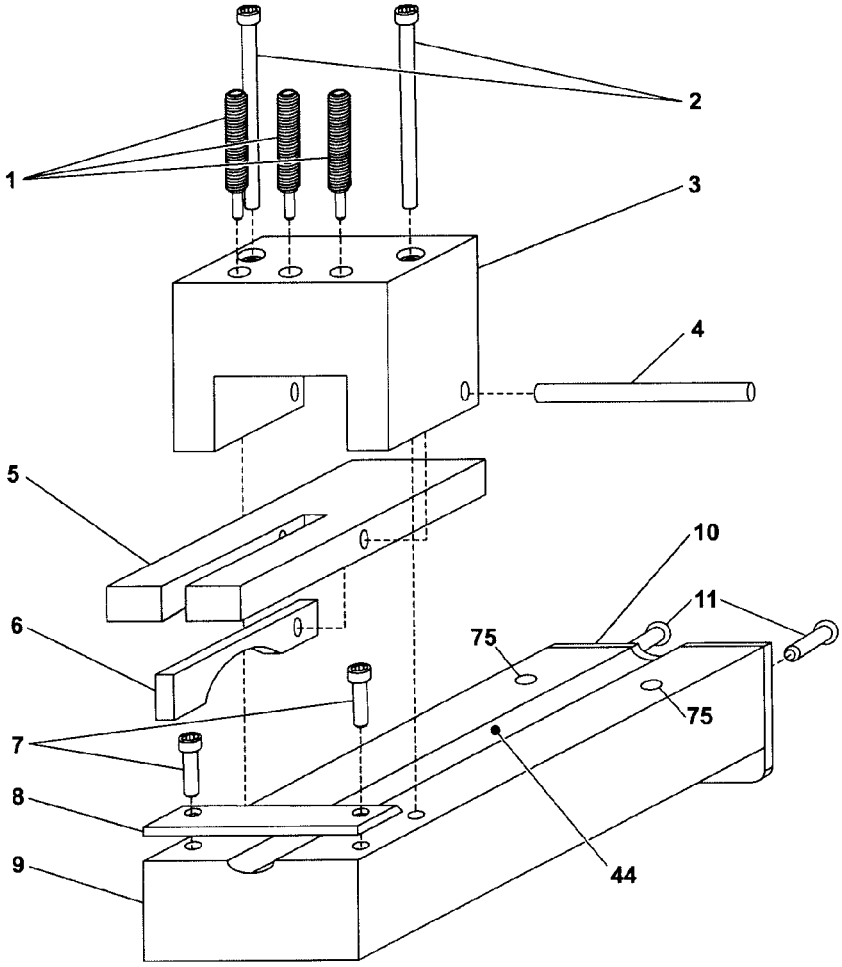
FIG. 2 is an exploded view of the filiere for double reeds shown in FIG. 1.
Figure 5:
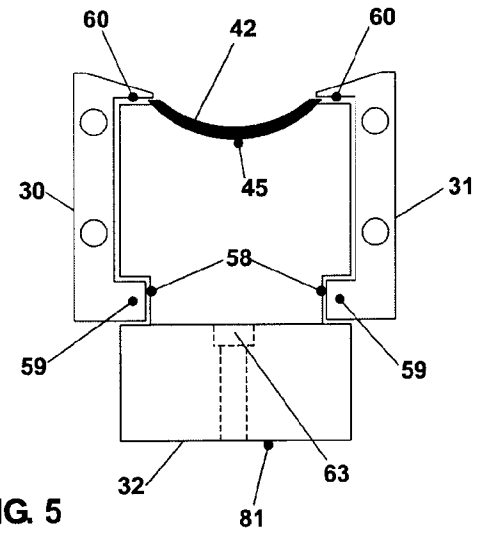
FIG. 5 is an end elevation view of a cane bed of the gouging machine for double reeds shown in FIG. 3 where an end cap has been removed for clarity.
Figure 6:
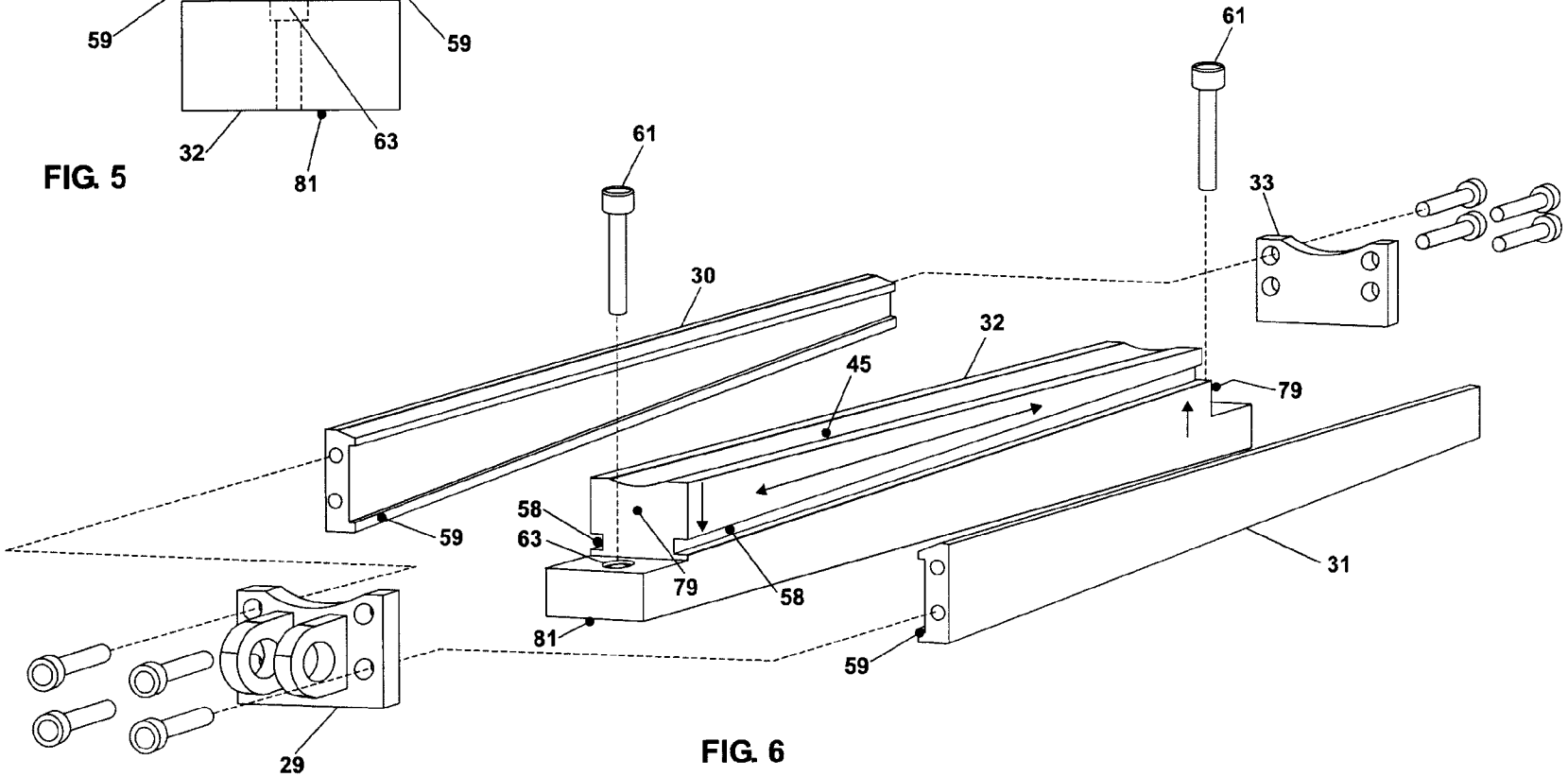
FIG. 6 shows an exploded view of a cane bed of the gouging machine shown in FIG. 3.

FIG. 1 is an isometric view of filiere 43 for double reeds that is fabricated in accordance with one or more embodiments of the present invention, and FIG. 2 is an exploded view of filiere 43 shown in FIG. 1. FIG. 5 is an end elevation view of cane bed 32 of gouging machine 1000 shown in FIG. 3 where end cap 29 has been removed for clarity. Further, FIG. 6 is an exploded view of cane bed 32 of gouging machine for double reeds 1000 shown in FIG. 3.

As shown in FIG. 2, filiere 43 comprises body 9 having trough 44 of circular cross-section extending inward from a flat surface of body 9 where the radius of curvature of trough 44 is suitable to that of cane to be gouged. For example, in accordance with one or more embodiments of the present invention, trough 44 of filiere 43 has the same radius of curvature as trough 45 of cane bed 32 of gouging machine 1000 (refer to FIG. 5 or FIG. 6), but trough 44 has a depth that is sufficiently greater than that of trough 45 so that the edges of pre-gouged cane (trimmed in filiere 43) will protrude above the top of cane bed 32 so that the edges may be gripped by edge gripping cane clamps 30 and 31 of gouging machine 1000.

Referring to FIG. 2, hold-down block 3 of filiere 43 is fastened to a top surface of body 9 by screws 2, and hold-down block 3 supports edge hold-down 5 and centre hold-down 6. In accordance with one or more such embodiments, edge hold-down 5 and centre hold-down 6 are free to pivot on axle 4, which axle 4 is supported by hold-down block 3. As further shown in FIG. 2, in accordance with one or more such embodiments, edge hold-down 5 is a plate which includes separated arms, which plate pivots on axle 4. As further shown in FIG. 2, in accordance with one or more such embodiments, centre hold-down 6 is an arm that is disposed between the separated arms of edge hold-down 5, which arm pivots on axle 4.

In addition, and in accordance with one or more such embodiments, downward forces are applied to edge hold-down 5 and centre hold-down 6 by force application mechanism 1 (for example and without limitation, an adjustable force application mechanism) that is affixed to hold-down block 3, which downward forces urge the arms of edge hold-down 5 and centre hold-down 6 toward the center and edges, respectively, of trough 44. In accordance with one or more such embodiments, such downward forces are sufficient to cause the pre-gouged cane to conform to the surface of trough 44 of filiere 43. In accordance with one or more such embodiments, the downward forces are provided by adjustable force application mechanisms such as, for example and without limitation, spring plungers. Suitable spring plungers may be obtained from KBC Tools (www.KBCTools.com), for example and without limitation, as KBC catalogue part number 1-903-52005. In further addition, bench hook 10 is fastened to a rear of body 9 by screws 11—bench hook 10 prevents filiere 43 from sliding while in use by contacting an edge of a reed maker's desk or workbench, and thereby, opposing a horizontal force applied to slide pre-gouged cane through filiere 43. Alternately, holes 75 passing vertically through body 9 of filiere 43 enable filiere 43 to be secured to a work surface using fasteners such as, for example and without limitation, screws. As further shown in FIG. 2, filiere 43 includes blade 8 which is disposed across trough 44, and is affixed to body 9 by screws 7 so that a cutting edge (i.e., a sharpened edge) of blade 8 faces toward bench hook 10 and extends across trough 44.

Figure 1A:
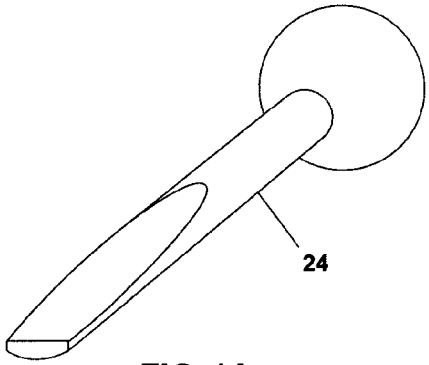
FIG. 1A shows a pushstick used with the filiere for double reeds shown in FIG. 1.

Filiere for double reeds 43 may be used to provide a constant arc length of the bark side of pre-gouged cane by placing a piece of split, pre-gouged cane, bark side down, in trough 44 of body 9. The cane may be either soaked in water or dry, according to the preference of the reed maker. The cross-section of the split cane ought to be slightly greater in width and height than that of trough 44, and the cane ought to have undergone a pre-gouging process to reduce its wall-thickness and increase its pliability by an amount sufficient to allow the cane to flex so that its bark side may be conformed to trough 44. Then, the split piece of cane is slid along trough 44 toward blade 8 by applying force to its trailing end with, for example and without limitation, pushstick 24 shown in FIG. 1A or with a similar tool. In accordance with one or more embodiments of the present invention, as the split piece of cane is slid along trough 44, edge hold-down 5 comes into contact with both edges of the cane, and centre hold-down 6 comes into contact with the centre of the cane. The concerted force of contact of edge hold-down 5 and centre hold-down 6 acting on pliable, pre-gouged cane urges the bark side of the cane into conformity with the surface of trough 44 at a point proximate to a cutting edge of blade 8. Then, as the cane is urged forward, blade 8 trims excess material from both edges of the cane. Since this trimming is carried out at a point where the cane is in conformity with the surface of trough 44, the cane emerges from filiere for double reeds 43 with a constant arc length, as measured circumferentially across the bark side of the cane at right angles to its length, regardless of variations naturally occurring in the curvature of the bark side of the cane.

As one of ordinary skill in the art can readily appreciate, further embodiments of filiere 43 may be fabricated without departing from the scope and spirit of the present invention. For example, further embodiments of the present invention exist wherein blade 8 and the hold-down mechanisms are affixed along trough 44 other than at an end. This may be done readily by increasing the length of body 9 and trough 44. In addition, further embodiments of the present invention exist wherein the arms of the hold-down mechanisms may have shapes other than those shown in FIG. 2, and the arms of center hold-down 5 may be separated using alternative constructions from those shown in FIG. 2. In further addition, further embodiments of the present invention exist wherein force application mechanism 1 may be fabricated using any one of a number of mechanisms that may serve as alternates of spring plungers. For example and without limitation, a suitable force application mechanism may be fabricated using leaf springs.

Figure 3:
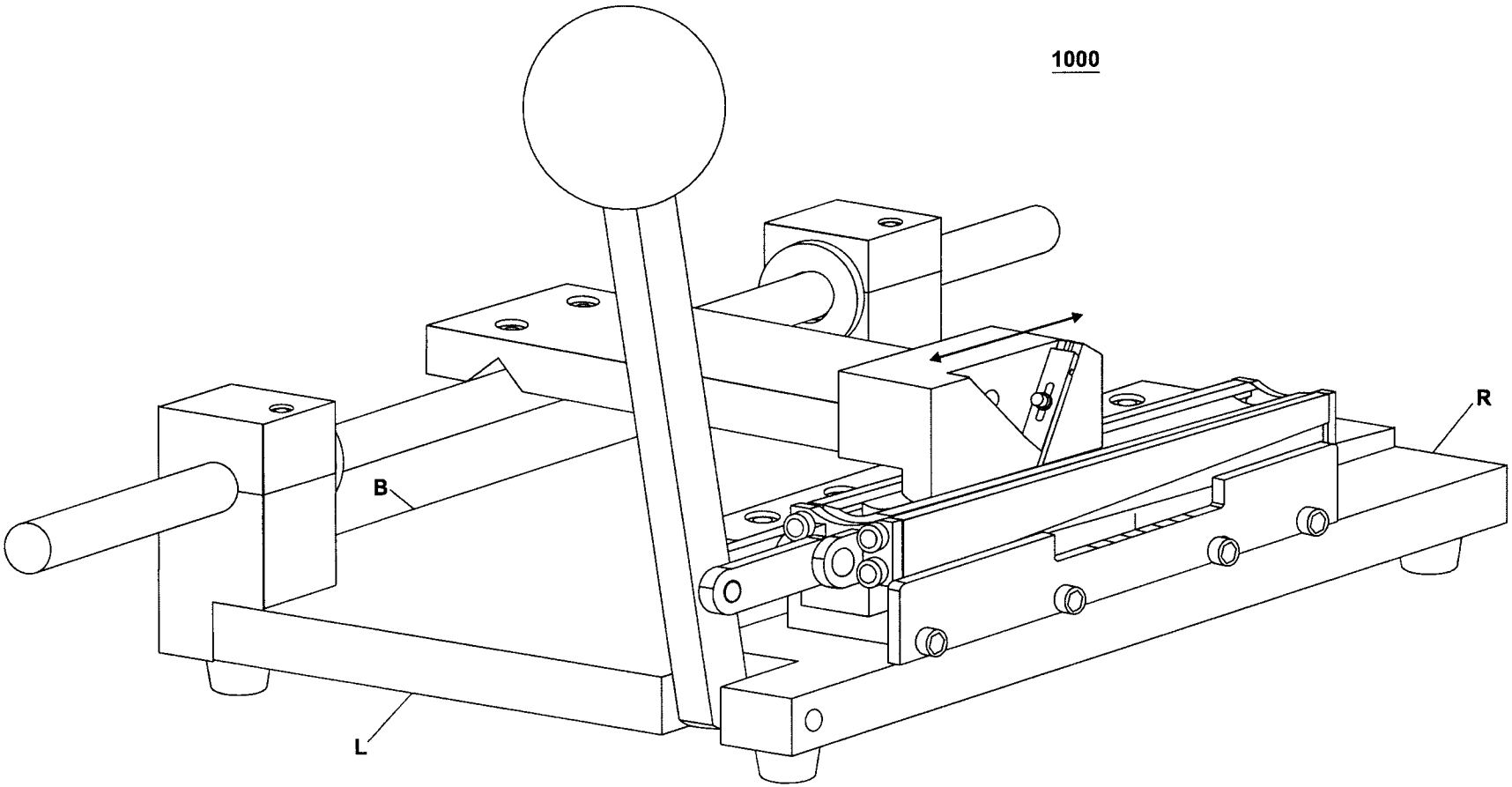
FIG. 3 is an isometric view of a gouging machine for double reeds that includes edge gripping cane clamps, which gouging machine is fabricated in accordance with one or more embodiments of the present invention.
Figure 4:
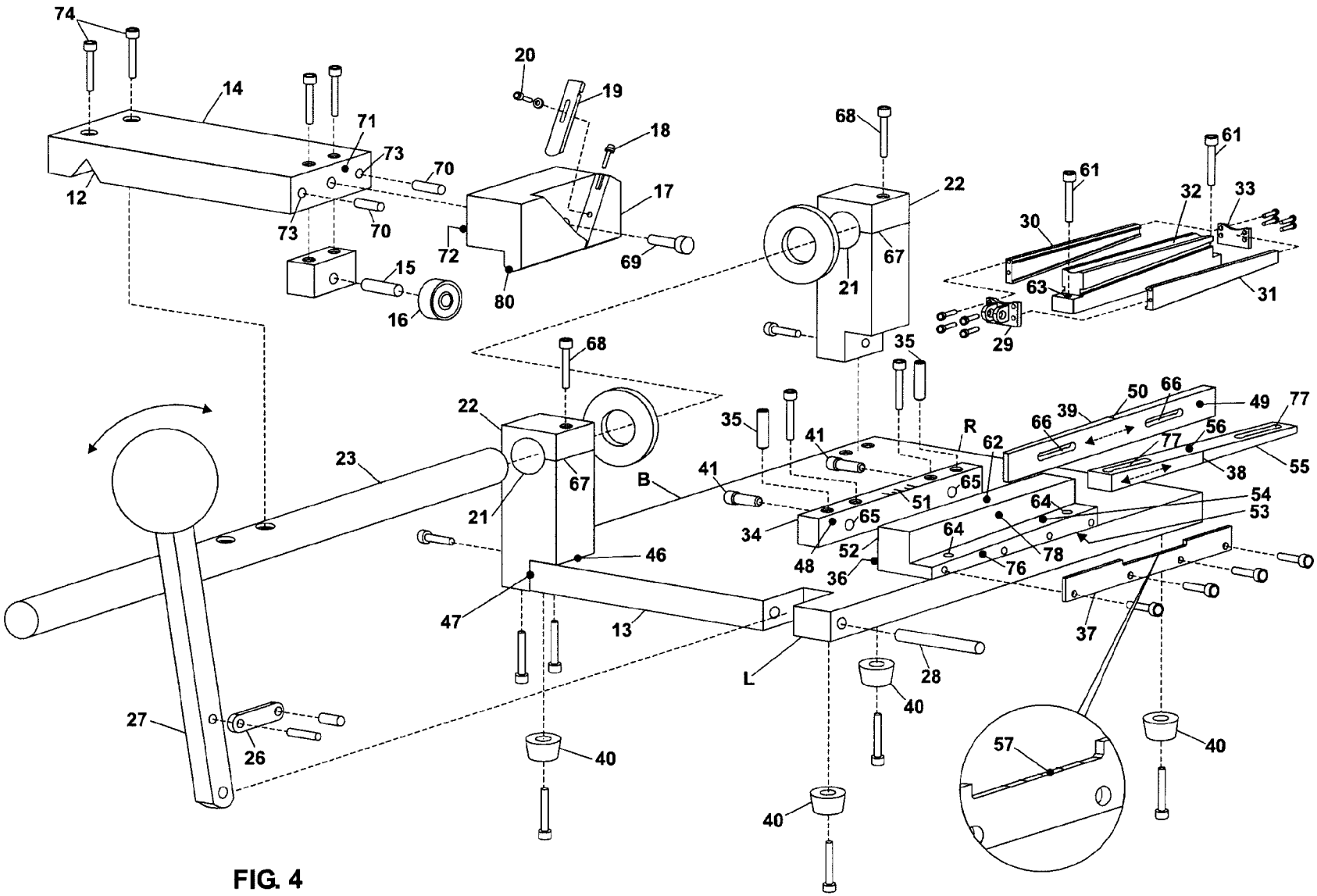
FIG. 4 is an exploded view of the gouging machine for double reeds shown in FIG. 3.

FIG. 3 is an isometric view of gouging machine for double reeds 1000 that includes edge gripping cane clamps 30 and 31, which gouging machine 1000 is fabricated in accordance with one or more embodiments of the present invention. FIG. 4 is an exploded view of gouging machine for double reeds 1000; FIG. 5 is an end elevation view of cane bed 32, edge gripping cane clamps 30 and 31, and cane 42 (with end cap 29 removed for clarity); and FIG. 6 is an exploded view of cane bed 32, slidable edge gripping cane clamps 30 and 31, and end caps 29 and 33 of gouging machine for double reeds 1000.

As shown in FIG. 4, gouging machine 1000 comprises base 13 having a rear edge B and a flat top surface. In accordance with one or more such embodiments, rubber bumpers 40 shown in FIG. 4 are fastened to a bottom surface of base 13 to prevent gouging machine 1000 from sliding on a work surface while in use. As further shown in FIG. 4, gouging machine 1000 further comprises a pair of bearing blocks 22, each having a bearing bore 21 which may be adjustable to compensate for wear to rod 23 and bearing bores 21 that may occur after prolonged use. Adjustability may be created by the use of slit 67 that extends through a side of bearing block 22 into bearing bore 21, which slit 67 may be adjusted by screw 68 which: (a) passes through a clearance hole above slit 67 and (b) is threaded into bearing block 22 below slit 67. As screw 68 is tightened, slit 67 is narrowed, and bearing bore 21 is reduced in diameter, thereby, taking up wear. Bearing blocks 22 also have bottom surface 46 and locating shoulder 47. Bearing blocks 22 are: (a) matched as to vertical distance from bottom surface 46 to a center of bearing bore 21; (b) matched as to horizontal distance from locating shoulders 47 to a vertical, imaginary line passing through the center of bearing bore 21; (c) matched as to a diameter of bearing bore 21 (i.e., bearing bores 21 of both bearing blocks 22 are equal to each other); and (d) fastened to base 13 so that: (i) bottom surface 46 of each bearing block 22 makes contact with a top surface of base 13, and (ii) locating shoulder 47 of each bearing block 22 makes contact with rear edge B of base 13. As indicated in FIG. 4, rod 23: (a) passes through each bearing bore 21; (b) is able to slide and rotate in each bearing bore 21; and (c) is parallel to the top surface of base 13 and to rear edge B of base 13.

As further indicated in FIG. 4, stationary wedge 34 having graduated scale 51 inscribed thereon is fastened to base 13, and is positively located thereon, by dowel pins 35. Each graduation of graduated scale 51: (a) is spaced, for example and without limitation, within a range of one half millimeter to two millimeters from each adjacent graduation; and (b) represents a predetermined unit of measurement (for example, and without limitation, one half to two thousandths of an inch or one half to two hundredths of a millimeter, with hundredths of a millimeter being preferred). Front surface 48 of stationary wedge 34 (i.e., a position-adjusting surface) forms a small angle with respect to rear edge B of base 13 (i.e., a position-adjusting angle), where a tangent of the angle is, for example and without limitation, in a range of one in two hundred to four in one hundred, with one in one hundred being preferred. As further indicated in FIG. 4, position-adjusting wedge 39 has witness mark 50 inscribed thereon. Further, opposing sides of position-adjusting wedge 39 are disposed at an angle which is equal to, and opposite from, the small angle between front surface 48 of stationary wedge 34 and rear edge B of base 13. Still further, position-adjusting wedge 39 makes contact with front surface 48 of stationary wedge 34 such that front surface 49 of position-adjusting wedge 39 is parallel to rear edge B of base 13.

In accordance with one or more embodiments of the present invention, front surface 76 of cane bed holder 52 is parallel to rear surface 36 of cane bed holder 52.

As further indicated in FIG. 4, cane bed holder 52 is fastened to the top surface of base 13 by screws 61 that: (a) pass through holes 63 in cane bed 32; (b) pass through holes 64 in cane bed holder 52; (c) pass through slots 77 in thickness-adjusting wedge 55; and (d) are threaded into the top surface of base 13. Holes 63 and 64 and slots 77 are large enough to permit adjustment of the position of cane bed holder 52, i.e., since screws 61 are threaded into base 13 and are unable to move closer or further from rod 23, holes 64 in cane bed holder 52, holes 63 in cane bed 32, and slots 77 in thickness-adjusting wedge 55 must offer sufficient clearance to screws 61 to allow cane bed holder 52, cane bed 32 and thickness-adjusting wedge 55 to be moved closer to, or further from rod 23. Cane bed holder 52 is also clamped to front surface 49 of position-adjusting wedge 39 by screws 41 that: (a) pass through holes 65 in stationary wedge 34; (b) pass through slots 66 in position-adjusting wedge 39; and (c) are threaded into rear surface 36 of cane bed holder 52. As a result, (a) rear surface 36 of cane bed holder 52 is parallel: (i) to rear edge B of base 13, and (ii) to rod 23; (b) front surface 76 of cane bed holder 52 is parallel: (i) to rear edge B of base 13, and (ii) to rod 23; and (c) bottom surface 53 of cane bed holder 52 is parallel: (i) to the top surface of base 13, and (ii) to rod 23. As shown in FIG. 4, sloping surface 54 of cane bed holder 52 makes a small angle with respect to bottom surface 53 of cane bed holder 52, where a tangent of the angle is, for example and without limitation, in a range of one in two hundred to four in one hundred, with one in one hundred being preferred.

As further indicated in FIG. 4, thickness-adjusting wedge 55 has witness mark 38 inscribed thereon. Further, opposing sides of thickness-adjusting wedge 55 are disposed at an angle which is equal to, and opposite from, the angle (i.e., a thickness-adjusting angle) that sloping surface 54 of cane bed holder 52 (i.e., a thickness-adjusting surface) makes with respect to bottom surface 53 of cane bed holder 52. Still further, thickness-adjusting wedge 55 contacts sloping surface 54 of cane bed holder 52 so that top surface 56 of thickness-adjusting wedge 55 is parallel to bottom surface 53 of cane bed holder 52 and to rod 23. When cover plate 37 (which includes graduated scale 57) is affixed to front surface 76 of cane bed holder 52, a groove is formed between cover plate 37 and vertical shoulder 78 of cane bed holder 52 that: (a) contains thickness-adjusting wedge 55 with sufficient clearance to allow it to slide horizontally; and (b) at least in part, exceeds top surface 56 of thickness-adjusting wedge 55 in height. In accordance with one or more such embodiments, the width of the groove between cover plate 37 and vertical shoulder 78 of cane bed holder 52 is equal to the width of cane bed 32, as measured from back to front. As indicated in FIG. 4, cane bed 32 is positively located parallel to, and a fixed distance from, rod 23 by being confined between vertical shoulder 78 of cane bed holder 52 and cover plate 37, and cane bed 32 is also able to move vertically (i.e., up or down) in response to changes in position of thickness adjusting wedge 55. As a result, trough 45 (refer to FIG. 5 or FIG. 6) of cane bed 32 will be parallel to rod 23 in every plane and to base 13. In particular, the top surface of cane bed 32 is parallel to the bottom surface of cane bed 32, and trough 45 is parallel to the top and bottom surfaces of cane bed 32.

In using gouging machine for double reeds 1000, it may be desired to adjust the position of cane bed trough 45 (refer to FIG. 5) either closer to, or further from, rod 23. In accordance with one or more embodiments of the present invention, such adjustment of the position of cane bed trough 45 is carried out by moving cane bed 32 using a position-adjuster comprised of stationary wedge 34, position-adjusting wedge 39 and cane bed holder 52. Such an adjustment of the position of cane bed trough 45 is carried out, in accordance with one or more embodiments of the present invention, by loosening screws 41 and 61 clamping cane bed holder 52 in place (refer to FIG. 4), sliding position-adjusting wedge 39 as needed, and re-clamping cane bed holder 52 by re-tightening screws 41 and 61. In accordance with one or more such embodiments, cane bed trough 45 will remain parallel to rod 23 after the adjustment, and the change in position of cane bed trough 45 will be of a known amount as witness mark 50 on position-adjusting wedge 39 will have moved against graduated scale 51 on stationary wedge 34 (where each graduation on graduated scale 51 represents a known unit of measurement (see above). As such, the effect of the adjustment may be assessed, and cane bed trough 45 may be moved accurately to a predetermined position, for example, and without limitation, an initial position, by re-adjusting position-adjusting wedge 39 so that witness mark 50 is at a predetermined, for example, a previous, position on graduated scale 51.

In using gouging machine for double reeds 1000, it may be desired to adjust the finished thickness of cane 42 (refer to FIG. 5) being gouged. In accordance with one or more embodiments of the present invention, such an adjustment of the finished thickness of cane 42 is carried out by raising or lowering cane bed 32 using a thickness-adjuster comprised of cane bed holder 52 and thickness adjusting wedge 55. To do this adjustment, screws 61 clamping cane bed 32 to top surface 56 of thickness-adjusting wedge 55 are loosened (cane bed holder 52 does not move as it is affixed to stationary wedge 34, and holes 65 therethrough for screws 41 have no room for movement in the direction of movement of thickness-adjusting wedge 55). Then, thickness-adjusting wedge 55 is slid by an amount equal to the desired adjustment (as indicated by movement of witness mark 38 on thickness-adjusting wedge 55 against graduated scale 57 of cover plate 37), where each graduation of graduated scale 57: (a) is spaced, for example and without limitation, within a range of one half millimeter to two millimeters from each adjacent graduation; and (b) represents a predetermined unit of measurement (for example, and without limitation, one half to two thousandths of an inch or one half to two hundredths of a millimeter, with hundredths of a millimeter being preferred). Then, cane bed 32 is re-clamped by re-tightening screws 61. As such, the effect of the adjustment may be assessed, and cane bed 32 may be moved accurately to a predetermined position, for example, and without limitation, an initial position, by re-adjusting thickness-adjusting wedge 55 so that witness mark 38 is at a predetermined, for example, and without limitation, a previous, position on graduated scale 57.

In accordance with one or more embodiments of the present invention, as shown in FIG. 6, cane bed 32 includes grooves 58 that slope at an angle with respect to bottom surface 81 of cane bed 32, where a tangent of the angle is, for example and without limitation, in a range of two in one hundred to fifteen in one hundred. As further shown in FIG. 6, edge gripping cane clamps 30 and 31 have tongues 59 that slope at an angle with respect to clamping surfaces 60 thereof (refer to FIG. 5), which angle is equal to that of sloping grooves 58 of cane bed 32. As a result, when tongues 59 engage grooves 58, clamping surfaces 60 of edge gripping cane clamps 30 and 31 are parallel to a bottom of trough 45. As further indicated in FIG. 6, clamps 30 and 31 are held in a fixed relationship to each other by end caps 29 and 33, and clamps 30 and 31 are longer than the length of cane bed 32 between end surfaces 79. This enables clamps 30 and 31 to be slid, and thereby to tighten or loosen their grip on a piece of cane during operation of gouging machine 1000.

In accordance with one or more embodiments of the present invention, as tongues 59 of edge gripping cane clamps 30 and 31 slide in grooves 58 of cane bed 32 towards edge L (refer to FIG. 3 or FIG. 4) of base 13, clamping surfaces 60 (refer to FIG. 5) of edge gripping cane clamps 30 and 31 fall towards trough 45. On the other hand, as tongues 59 of edge gripping cane clamps 30 and 31 slide in grooves 58 of cane bed 32 towards edge R (refer to FIG. 3 or FIG. 4) of base 13, clamping surfaces 60 of edge gripping cane clamps 30 and 31 rise away from trough 45. As shown in FIG. 3, and as indicated in FIG. 4, motion of lever 27 pivoting on axle 28 imparts motion to end cap 29 through connecting link 26 which, in turn, imparts sliding motion to clamps 30 and 31. The length of sliding motion of clamps 30 and 31 is limited by end caps 29 and 33 touching end surfaces 79 of cane bed 32. Therefore, clamps 30 and 31 must be sufficiently longer than the length of cane bed 32 between end surfaces 79 that the highest position of clamping surfaces 60, achieved when edge gripping cane clamps 30 and 31 are slid to the limit of their motion towards edge R of base 13, will create clearance below clamping surfaces 60 sufficient to allow the insertion of pregouged and trimmed cane 42 into cane bed 32.

In accordance with one or more such embodiments of the present invention, referring to FIG. 5, clamping surfaces 60 of edge gripping cane clamps 30 and 31 contact extreme edges of cane 42 and exert a downward force thereon, which downward force: (a) causes the bark side of cane 42 to conform to trough 45; and (b) clamps the cane tightly in place. Since the slope between tongues 59 and clamping surfaces 60 is in a self-holding range (for example, and without limitation, a slope at an angle whose tangent is in a range of, for example and without limitation, two in one hundred to fifteen in one hundred (see above)), clamps 30 and 31, once tightened by motion of lever 27, retain a grip on cane 42 throughout the gouging operation.

In accordance with one or more further embodiments of the present invention, cane bed 32 may further include a cane stop (not shown, for example and without limitation, a rectangular metal plate having a concave top edge) which would be fastened to an end of cane bed 32 which is nearest edge L (refer to FIG. 3 or FIG. 4) of base 13 and which would partially obstruct trough 45 so that cane 42 would be prevented from sliding beyond the edge of trough 45 which is nearest edge L but without obstructing blade 19 (refer to FIG. 4).

As further indicated in FIG. 4, gouging machine for double reeds 1000 includes a cutting tool that includes carriage 14 having depth stop roller 16 and depth stop arbor 15. Carriage 14 is mounted on rod 23, which rod 23 is able to slide through, and rotate in, bearing blocks 22. As indicated in FIG. 4, carriage 14 is fastened to rod 23 by clamping v-groove 12 (located in a bottom surface of carriage 14) to the outside diameter of rod 23 with screws 74. A grip or handle (not shown) may be fastened to carriage 14 to promote the comfort of the reed maker. As further indicated in FIG. 4, rear surface 72 of blade holder 17 is clamped to front surface 71 of carriage 14 by screw 69. In addition, as further indicated in FIG. 4, blade holder 17 is positively located on front surface 71 of carriage 14 by dowel pins 70, which dowel pins 70 engage sockets 73 in front surface 71 of carriage 14, and also engage corresponding sockets in rear surface 72 of blade holder 17. In accordance with one or more such embodiments, angular play in carriage 14 (created by clearance between an outside diameter of rod 23 and an inside diameter of bores 21 through bearing blocks 22) is controlled by: (a) a wide spacing of bearing blocks 22, which spacing may be, for example and without limitation, equal to or greater than a sum of the length of the cane being gouged and the length of carriage 14, as measured along rod 23; and (b) the adjustable diameter of bearing bores 21, described above.

In accordance with one or more such embodiments, gouging is carried out by first inserting a pregouged, trimmed piece of cane 42 into cane bed 32 and clamping it to the surface of trough 45 using edge gripping cane clamps 30 and 31 (see above). Cane 42 may be either soaked in water or dry, depending on the preference of the reed maker. Then, by a rotational movement of rod 23 (refer to FIG. 4), carriage 14 descends toward base 13 until guide surface 80 of blade holder 17 rests upon cane 42. Then, carriage 14 is repeatedly moved, for example, and without limitation, from a starting position near edge R of base 13 to a finish position near edge L of base 13. Such motion may be imparted, for example and without limitation, by hand or by a suitable mechanical device. During such movement of carriage 14, blade 19 (whose curved edge protrudes beyond guide surface 80 of blade holder 17) removes excess material from cane 42 in the form of thin shavings in the manner of a wood plane. After removal of each shaving, blade holder 17 and carriage 14 (pivoting on rod 23) descend incrementally lower until stop roller 16 contacts, and rolls along, top surface 62 of cane bed holder 52. At that point, carriage 14 has reached a predetermined height, is parallel to base 13, and cane 42 has been gouged to finished dimensions.

As indicated in FIG. 4, blade holder 17 is fastened to carriage 14 by screw 69 and it is positively located by dowel pins 70. As further indicated in FIG. 4, blade 19 is affixed to blade holder 17 by screw 20 which extends through a slot in blade 19. In accordance with one or more such embodiments, blade 19 includes a slot in its rear surface (not shown), which slot engages a flange of adjusting screw 18. As such, the position of blade 19 may be adjusted finely by loosening screw 20, turning adjusting screw 18 to move blade 19 in a desired direction, and re-tightening screw 20. In accordance with one or more such embodiments, carriage 14 can be removed from rod 23 to facilitate adjustment of blade 19 after sharpening, and can be replaced without loss of position or alignment. As one of ordinary skill in the art can readily appreciate, blade 19 gouges the split, pre-gouged piece of cane by removing excess material in the form of shavings in a manner similar to a wood plane.

In accordance with one or more alternative embodiments of the present invention, gouging entails removing excess material with an abrasive tool which replaces the blade assemblage of gouging machine 1000. In accordance with one or more such embodiments, the abrasive tool is comprised, for example and without limitation, of a disc with a suitably contoured edge such as, for example and without limitation, an edge having a circular radius. In accordance with one or more such alternative embodiments, the disc is carried by a rotating horizontal spindle which is slidably mounted parallel to base 13 and at right angles to trough 45. As such, relative motion caused, for example and without limitation, by hand, by a hydraulic cylinder or by a feedscrew equipped with a reversible motor, of the spindle parallel to trough 45 would cause the abrasive tool to gouge cane 42 to finished dimensions.

In accordance with one or more embodiments of the present invention, body 9 and hold-downs 5 and 6 of filiere 43, blade holder 17, endcaps 29 and 33, and edge gripping cane clamps 30 and 31 of gouging machine 1000 may be made, for example and without limitation, of stainless steel which provides corrosion and wear resistance. In addition, hold-down block 3 of filiere 43 may be made, for example and without limitation, of aluminum for its corrosion resistance and machinability. In further addition, blade 8 of filiere 43 and blade 19 of gouging machine 1000 may be made, for example and without limitation, of hardened tool steel in a range of Rockwell Cscale 56-62 to provide resistance to wear and an ability to retain sharpness. In still further addition, cane bed 32 and bearing blocks 22 of gouging machine may advantageously be made, for example and without limitation, of bronze to provide anti-seizing properties. In yet still further addition, cane bed holder 52, position-adjusting wedge 39, height-adjusting wedge 55, stationary wedge 34 and cover plate 37 may be made, for example and without limitation, of steel for its suitability for precision grinding. Lastly, base 13 of gouging machine 1000 may be made, for example and without limitation, of painted steel or aluminum to provide corrosion resistance, and all other parts may be made, for example and without limitation, of steel.

As one of ordinary skill in the art can readily appreciate, further embodiments of gouging machine 1000 may be fabricated without departing from the scope and spirit of the present invention. For example, although alignment of various components was described with respect to rear edge B of base 13 (refer to FIGS. 3 and 4), further embodiments of the present invention exist wherein such alignment is made with respect to another predetermined surface. In such a case, for example, the slope of a front surface of stationary wedge 34 would be taken with respect to the predetermined surface, and for embodiments where a rear surface of wedge 34 were aligned parallel to the predetermined surface, the slope of the front surface of wedge 34 would be with respect to the back surface of stationary wedge 34, and so forth for other relevant components. As a further example, although alignment of various components was described with respect to rod 23 (refer to FIG. 4) which in turn was described as being parallel to rear edge B, further embodiments of the present invention exist wherein such alignment is made with respect to a predetermined line which is parallel to a predetermined surface. In particular, when the description above referred to surfaces of components being parallel to rod 23, this also can be interpreted as being parallel to a line which is parallel to rod 23.

The inventor has discovered that filiere for double reeds 43 is able to trim pre-gouged split pieces of cane so they have a consistent, constant arc length, as measured circumferentially across the bark side of the cane at right angles to its length. This enables a gouging machine for double reeds equipped with edge gripping cane clamps to grip the cane tightly, at all points along its length. In addition, the inventor has discovered that the edge gripping cane clamps of gouging machine for double reeds 1000 apply a downward force to the edges of the cane being gouged, thereby substantially conforming the bark side of the cane to the trough of the cane bed. With the bark side of the cane in solid contact with the trough, natural variations in the curvature of the bark side of the cane are overcome and cane can be gouged to consistent dimensions with repeatability. In further addition, the inventor has discovered that the clamping surfaces of the edge gripping cane clamps of gouging machine for double reeds 1000 remain at equal heights at all times. As a result, the cane is gripped in a self leveling manner, and therefore, the thickest part of the gouge is consistently centered between the edges of the cane, whether the machine is used for single radius or double radius gouging. In still further addition, the inventor has discovered that the adjusting mechanisms of gouging machine for double reeds 1000 allow the cane bed to be moved relative to the cutting tool in precise, known amounts—the use of adjustable wedges having graduated scales and witness marks allows adjustments to be made by precisely known amounts to both the thickness of the gouged cane and the lateral position of the cutting tool over the trough of the cane bed, and as precisely reversed if their effect is unsatisfactory.

Embodiments of the present invention described above are exemplary, and many changes and modifications may be made to the description set forth above by those of ordinary skill in the art while remaining within the scope of the present invention. As such, the scope of the present invention should be determined with reference to the appended claims along with their full scope of equivalents.

What is claimed is:

1. A gouging machine for cane comprises:

a base, wherein at least a portion of a top surface of the base is disposed in a plane;

a cane bed, having a trough disposed parallel to a bottom surface of the cane bed, and having grooves on opposing sides of the cane bed, which grooves slope at a non-zero groove angle with respect to the bottom surface of the cane bed, the cane bed being affixed to the base so that the trough is parallel to the plane and to an alignment line, wherein the alignment line is disposed along an alignment direction and is parallel to the plane;

clamps, disposed on the opposing sides of the cane bed, each clamp having a tongue that slopes at the groove angle with respect to a clamping surface thereof, which clamping surface is adapted to grip edges of cane placed in the trough of the cane bed, and wherein the tongues of the clamps slidably engage the grooves of the cane bed so that the clamping surface of the clamps are parallel to a bottom of the trough; and a cutting tool comprising a cutting portion adapted to be positioned over, and to move along, the trough.

2. The gouging machine of claim 1 which further comprises:

a thickness-adjuster abutted to the cane bed which adjusts a height of the trough of the cane bed with respect to the plane;

wherein the cutting portion is further adapted to move along the trough to gouge cane parallel to the alignment direction.

3. The gouging machine of claim 2 wherein the thickness-adjuster comprises:

a cane bed holder, having a thickness-adjusting surface disposed at a thickness-adjusting angle, the cane bed holder being movably affixed to the base;

a thickness-adjusting wedge having the thickness-adjusting angle, the thickness-adjusting wedge being disposed on, and movable on, the thickness-adjusting surface so that a top surface of the thickness-adjusting wedge is parallel to the plane;

wherein the cane bed is movably affixed to: (a) the top surface of the thickness-adjusting wedge, (b) the cane bed holder, and (c) the base.

4. The gouging machine of claim 3 which further comprises:

a cover plate affixed to a side of the cane bed holder so that a portion of the cover plate extends above the top surface of the thickness-adjusting wedge.

5. The gouging machine of claim 4 wherein the thickness-adjusting wedge includes a witness mark on a side thereof and the cover plate includes a scale on a top surface thereof.

6. The gouging machine of claim 5 which further comprises:

end caps affixed to ends of the clamps; and means, affixed to an end cap, for moving the clamps.

7. The gouging machine of claim 6 wherein the cutting tool comprises:

bearing blocks having bores therethrough;

a rod adapted to slide through and rotate in the bores parallel to the alignment direction;

a carriage affixed to the rod; and the cutting portion, wherein the cutting portion includes a blade holder fastened to the carriage which includes a blade.

8. The gouging machine of claim 1 which further comprises:

a position-adjuster which adjusts a position of the trough of the cane bed with respect to the alignment line.

9. The gouging machine of claim 8 wherein the position-adjuster comprises:

a stationary wedge having a position-adjusting surface disposed at a position-adjusting angle, the stationary wedge being affixed to the base;

a position-adjusting wedge having the position-adjusting angle, the position-adjusting wedge being disposed on, and movable on, the position-adjusting surface so that a front surface of the position-adjusting wedge is parallel to an alignment surface; and a cane bed holder that is movably affixed to the stationary wedge, the position-adjusting wedge, the base, and the cane bed.

10. The gouging machine of claim 9 which further comprises:

end caps affixed to ends of the clamps; and means, affixed to an end cap, for moving the clamps.

11. The gouging machine of claim 10 wherein the cutting tool comprises:

bearing blocks having bores therethrough;

a rod adapted to slide through and rotate in the bores parallel to the alignment direction;

a carriage affixed to the rod; and the cutting portion, wherein the cutting portion includes a blade holder fastened to the carriage which includes a blade.

12. A gouging machine for cane comprises:

a base, wherein at least a portion of a top surface of the base is disposed in a plane;

a cane bed holder, having a sloping surface that slopes at a thickness-adjusting angle with respect to a bottom surface of the cane bed holder, and having first and second front surfaces that are disposed parallel to an alignment a surface, the bottom surface being mounted on the base;

a cover plate, having a scale inscribed on a top surface thereof, the cover plate being mounted to the first front surface of the cane bed holder to form a groove;

a thickness-adjusting wedge having a top surface that slopes at the thickness-adjusting angle with respect to a bottom surface of the thickness-adjusting wedge, and having a witness mark on a side surface thereof, the thickness-adjusting wedge being mounted on the sloping surface of the cane bed holder, in the groove, so that the top surface of the thickness-adjusting wedge is parallel to the plane;

a stationary wedge having a scale inscribed on a top surface thereof, the stationary wedge being mounted to the base and having a front surface that slopes at a position-adjusting angle with respect to the alignment surface;

a position-adjusting wedge having a front surface that slopes at the position-adjusting angle with respect to a back surface of the position-adjusting wedge, and having a witness mark inscribed on a top surface thereof, the position-adjusting wedge being mounted on the base so the back surface of the position-adjusting wedge abuts the front surface of the stationary wedge so that the front surface of the position-adjusting wedge is parallel to the alignment surface, and the front surface of the position-adjusting wedge is abutted and affixed to a back surface of the cane bed holder;

a cane bed, having a trough disposed parallel to a bottom surface of the cane bed, and having grooves on opposing sides of the cane bed, which grooves slope at a non-zero groove angle with respect to the bottom surface of the cane bed, the cane bed being mounted on the thickness-adjusting wedge, abutting the second front surface of the cane bed holder, and being affixed to the base; and clamps, disposed on the opposing sides of the cane bed, each clamp having a tongue that slopes at the groove angle with respect to a clamping surface thereof, which clamping surface is adapted to grip edges of cane placed in the trough of the cane bed, and wherein the tongues of the clamps slidably engage the grooves of the cane bed so that the clamping surface of the clamps are parallel to a bottom of the trough.

* * * * *